US009153181B2

(12) United States Patent
Miyaguchi

(10) Patent No.: US 9,153,181 B2
(45) Date of Patent: Oct. 6, 2015

(54) ELECTRONIC BOOK USING GRAYSCALE INVERSION FOR IMAGE SIGNAL CORRECTION

(75) Inventor: Atsushi Miyaguchi, Kanagawa (JP)

(73) Assignee: Semiconductor Energy Laboratory Co., Ltd., Kanagawa (JP)

( * ) Notice: Subject to any disclaimer, the term of this patent is extended or adjusted under 35 U.S.C. 154(b) by 1185 days.

(21) Appl. No.: 12/844,005

(22) Filed: Jul. 27, 2010

(65) Prior Publication Data

US 2011/0032227 A1 Feb. 10, 2011

(30) Foreign Application Priority Data

Aug. 6, 2009 (JP) ..... 2009-182946

(51) Int. Cl.
*G09G 3/34* (2006.01)

(52) U.S. Cl.
CPC ..... *G09G 3/344* (2013.01); *G09G 2310/0254* (2013.01); *G09G 2320/0271* (2013.01); *G09G 2360/144* (2013.01); *G09G 2380/02* (2013.01); *G09G 2380/14* (2013.01)

(58) Field of Classification Search
CPC . G09G 3/344; G09G 5/26; G09G 2320/0271; G09G 2320/0613; G09G 2360/144; G09G 2380/14; G09G 2310/0254; G09G 2380/02; G02F 1/167
USPC ..... 345/107, 207, 214, 690, 901; 359/296
See application file for complete search history.

(56) References Cited

U.S. PATENT DOCUMENTS

| | | | | |
|---|---|---|---|---|
| 6,219,021 | B1 | 4/2001 | Izumi | |
| 6,529,211 | B2 * | 3/2003 | Ohara et al. | 345/690 |
| 6,885,146 | B2 | 4/2005 | Yamazaki et al. | |
| 6,995,753 | B2 | 2/2006 | Yamazaki et al. | |
| 7,378,791 | B2 | 5/2008 | Yamazaki et al. | |
| 7,636,078 | B2 | 12/2009 | Yamazaki et al. | |
| 7,724,247 | B2 | 5/2010 | Yamazaki et al. | |
| 7,830,370 | B2 | 11/2010 | Yamazaki et al. | |
| 8,264,437 | B2 * | 9/2012 | Nitanda | 345/89 |
| 8,319,714 | B2 | 11/2012 | Kojima et al. | |
| 8,599,124 | B2 | 12/2013 | Yamazaki et al. | |
| 2005/0134461 | A1 | 6/2005 | Gelbman et al. | |
| 2006/0158458 | A1 * | 7/2006 | Kojima et al. | 345/592 |
| 2006/0244702 | A1 * | 11/2006 | Yamazaki et al. | 345/89 |
| 2007/0146356 | A1 * | 6/2007 | Ladouceur | 345/207 |
| 2008/0001881 | A1 * | 1/2008 | Baba et al. | 345/89 |

(Continued)

FOREIGN PATENT DOCUMENTS

| | | |
|---|---|---|
| JP | 10-282474 A | 10/1998 |
| JP | 11-102171 | 4/1999 |

(Continued)

*Primary Examiner* — Temesgh Ghebretinsae
*Assistant Examiner* — Keith Crawley
(74) *Attorney, Agent, or Firm* — Nixon Peabody LLP; Jeffrey L. Costellia

(57) ABSTRACT

An object is to improve visibility without causing increases in device size and cost. Another object is to improve visibility and reduce the burden on a user without blocking external light when reflection of external light is high. An electronic book includes a display panel having an electrophoretic display element controllable by a pixel circuit of each pixel, and an illuminance sensor, and a display control portion having a circuit configured to correct an image signal for the electrophoretic display element to display a grayscale image in accordance with illuminance that is detected by the illuminance sensor.

8 Claims, 8 Drawing Sheets

(56) References Cited

U.S. PATENT DOCUMENTS

| | | | | |
|---|---|---|---|---|
| 2008/0001974 | A1* | 1/2008 | Kim et al. | 345/690 |
| 2008/0248609 | A1 | 10/2008 | Yamazaki et al. | |
| 2008/0316167 | A1* | 12/2008 | Kurokawa et al. | 345/102 |
| 2009/0189884 | A1* | 7/2009 | Maeda | 345/214 |
| 2009/0231267 | A1* | 9/2009 | Uchida | 345/107 |
| 2009/0256847 | A1* | 10/2009 | Hayashi | 345/472 |
| 2009/0278774 | A1* | 11/2009 | Chen et al. | 345/83 |
| 2010/0129528 | A1 | 5/2010 | Yamazaki et al. | |
| 2010/0149145 | A1* | 6/2010 | Van Woudenberg et al. | 345/207 |
| 2013/0076775 | A1 | 3/2013 | Kojima et al. | |

FOREIGN PATENT DOCUMENTS

| | | | |
|---|---|---|---|
| JP | 2002-062856 | A | 2/2002 |
| JP | 2003-076355 | A | 3/2003 |
| JP | 2003-337353 | | 11/2003 |
| JP | 2006-317897 | A | 11/2006 |
| JP | 2006-337997 | | 12/2006 |
| JP | 2006-350311 | A | 12/2006 |
| JP | 2008-145447 | A | 6/2008 |
| JP | 2008-537161 | | 9/2008 |
| JP | 2009-053534 | | 3/2009 |
| WO | WO-2006/103597 | | 10/2006 |
| WO | WO-2006/104212 | | 10/2006 |

* cited by examiner

ELECTRONIC BOOK USING GRAYSCALE INVERSION FOR IMAGE SIGNAL CORRECTION

BACKGROUND OF THE INVENTION

1. Field of the Invention

The technical field relates to an electronic book.

2. Description of the Related Art

In recent years, electronic paper (also referred to as digital paper or a paper like display) has attracted attention and has been partly put into practical use. The ultimate form of electronic paper is that which has small thickness and high visibility like paper, and is rewritable and maintains display even after power is turned off.

Among electronic paper techniques, a method for displaying images by using an electric field to promote movement and rotation of microparticles is referred to as an electrophoretic method. Electronic paper employing the electrophoretic method (hereinafter referred to as an electrophoretic display device) is disclosed in Patent Document 1.

REFERENCE

[Patent Document 1] Japanese Published Patent Application No. 2003-337353

SUMMARY OF THE INVENTION

Unlike a self light emitting display device, an electrophoretic display device enables a visible display by utilizing reflection of external light. Thus, the electrophoretic display device has significantly low visibility in an indoor area or the like where illuminance is low. In order to improve visibility of an electrophoretic display device, external light from a light, a frontlight, or the like is needed. An electrophoretic display device configured with a frontlight or the like to have higher visibility has problems such as increases in device size and cost. There is also a problem in that improvement of visibility cannot be expected in an outdoor area where external light from a light cannot be expected.

In addition, reflection of external light from an electrophoretic display device is high in a sunny outdoor area or the like where illuminance is high. Therefore, there is a concern about eyestrain caused by prolonged viewing. In order to suppress external light reflection and relieve eyestrain, external light needs to be blocked. There is a problem in that blocking of external light cannot be expected in a place around which there is no building or the like.

Thus, it is an object of an embodiment of the present invention to improve visibility without causing increases in device size and cost. It is also an object of an embodiment of the present invention to improve visibility without blocking external light when reflection of external light is high.

An embodiment of the present invention is an electronic book including a display panel having an electrophoretic display element controllable by a pixel circuit of each pixel, and an illuminance sensor, and a display control portion having a circuit configured to correct an image signal for the electrophoretic display element to display a grayscale image in accordance with illuminance that is detected by the illuminance sensor.

An embodiment of the present invention is an electronic book including a display panel having an electrophoretic display element controllable by a pixel circuit of each pixel, and an illuminance sensor, and a display control portion having a grayscale correction circuit, an arithmetic circuit, and an image signal generation circuit. The grayscale correction circuit controllable by the arithmetic circuit is a circuit configured to correct a grayscale level of an image signal to be input to the image signal generation circuit, for the electrophoretic display element to display a grayscale image in accordance with illuminance that is detected by the illuminance sensor.

An embodiment of the present invention is an electronic book including a display panel having an electrophoretic display element controllable by a pixel circuit of each pixel, and an illuminance sensor, and a display control portion having a circuit configured to correct an image signal for the electrophoretic display element to display an enlarged character and a circuit configured to correct an image signal to display a grayscale image, in accordance with illuminance that is detected by the illuminance sensor.

An embodiment of the present invention is an electronic book including a display panel having an electrophoretic display element controllable by a pixel circuit of each pixel, and an illuminance sensor, and a display control portion having a grayscale correction circuit, an arithmetic circuit, a character enlargement circuit, and an image signal generation circuit. The character enlargement circuit controllable by the arithmetic circuit is a circuit configured to correct an image signal to be input to the image signal generation circuit, for the electrophoretic display element to display an enlarged character in accordance with illuminance that is detected by the illuminance sensor. The grayscale correction circuit controllable by the arithmetic circuit is a circuit configured to correct a grayscale level of an image signal to be input to the image signal generation circuit, for the electrophoretic display element to display a grayscale image in accordance with illuminance that is detected by the illuminance sensor.

In the electronic book of one embodiment of the present invention, the display control portion may have a memory portion, a data input/output portion, an operation portion, and a power supply portion.

In the electronic book of one embodiment of the present invention, the correction of a grayscale level of an image signal may be a process for inverting a grayscale level of an image signal from black to white or from white to black.

In an embodiment of the present invention, due to a difference in external light reflectance between a white background and a black background, visibility can be ensured without causing increases in device size and cost even in the case where contrast changes depending on the level of illuminance. In addition, an embodiment of the present invention can be realized by correction of a signal to be input to a display portion, such as black-to-white inversion of an image. Therefore, visibility can be improved without any significant design changes (such as incorporation of a frontlight and blocking of external light).

DETAILED DESCRIPTION OF THE INVENTION

Figure 1:
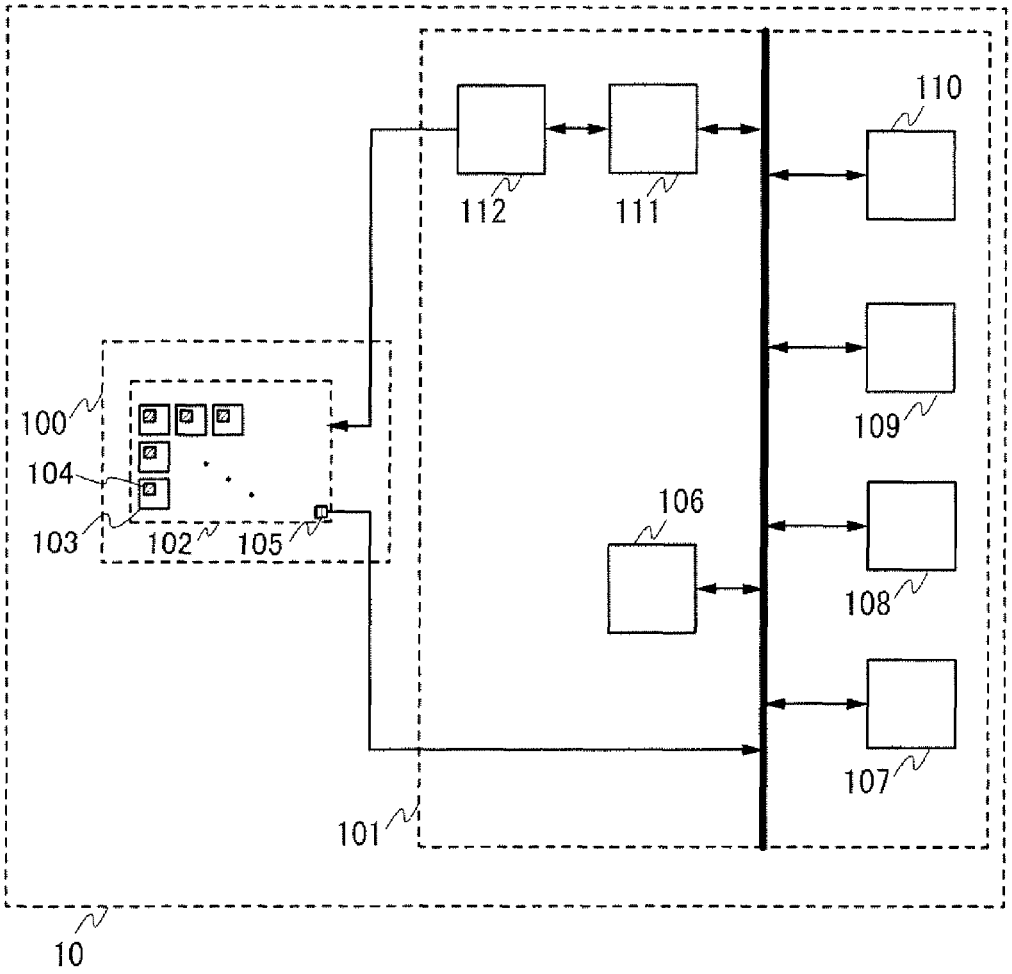
FIG. 1 is a block diagram illustrating an embodiment of the present invention.

Embodiments are described below in detail with reference to the drawings. Note that the present invention is not limited to the description of the embodiments, and it is apparent to those skilled in the art that modes and details of the present invention can be modified in various ways without departing from the spirit of the present invention disclosed in this specification and the like. Structures of different embodiments can be implemented in an appropriate combination. Note that in the structures of the present invention described below, like portions or portions having a similar function are denoted by like reference numerals, and the description thereof is omitted.

Note that the size, the thickness of a layer, or a region of each component illustrated in the drawings or the like in embodiments may be exaggerated for clarity in some cases. Therefore, the scale is not necessarily limited to that illustrated in the drawings.

Note that the numeral terms such as "first", "second", and "third" in this specification are used in order to avoid confusion between components and do not set a limitation on number.

Embodiment 1

With reference to FIG. 1, FIGS. 2A to 2C, and FIG. 3, an outline of a structure disclosed in this embodiment is described.

FIG. 1 is a block diagram of an electronic book described in this embodiment. An electronic book 10 shown in FIG. 1 includes a display panel 100 and a display control portion 101.

Note that the display panel 100 may be formed using a flexible substrate. When the display panel 100 is formed using a flexible substrate, a feeling of strangeness due to the difference from a paper book can be reduced. The electronic book 10 may have a structure in which the display panel 100 includes a driver circuit. With the structure in which the display panel 100 includes a driver circuit for performing display, reductions in size and cost of the electronic book 10 can be achieved. Note that the electronic book 10 may have a structure in which a signal for driving the display panel 100 is input from the outside. The electronic book 10 may also have a structure in which a plurality of display panels 100 or display control portions 101 is provided.

The display panel 100 includes a display portion 102 and the display portion 102 has a plurality of pixels 103. The plurality of pixels 103 is provided with a pixel circuit 104 for controlling an electrophoretic display element (also referred to as an electrophoretic element). The pixel circuit 104 is formed with a thin film transistor or the like. By forming the pixel circuit 104 with a thin film transistor, a cost reduction owing to a low-temperature process using an inexpensive substrate such as a glass substrate can be achieved. In addition, the display portion 102 has an illuminance sensor 105 (also referred to as an optical sensor).

Note that the electrophoretic display element is not limited to an element using electrophoresis and refers to elements which perform display through a phenomenon such as particle movement, particle rotation, or phase change. For example, as the electrophoretic display element, a microcapsule electrophoretic element, a horizontal electrophoretic element, a vertical electrophoretic element, a spherical twist ball display element, a magnetic twist ball, or the like can be used. The electrophoretic display element has advantages such as high reflectance, wide viewing angle, and low power consumption because of its memory properties.

The illuminance sensor 105 functions to detect the level of illuminance in the vicinity of the display panel 100. Therefore, the illuminance sensor 105 may be configured with a photoelectric conversion element such as a photodiode. In addition, a plurality of illuminance sensors 105 may be provided. It is preferable to use a plurality of illuminance sensors to calculate the average of levels of illuminance detected by the plurality of illuminance sensors, in which case the level of illuminance in the vicinity of the display panel 100 can be detected with accuracy.

Note that as the illuminance sensor 105, a photodiode or a phototransistor can be formed over a substrate where a thin film transistor included in the pixel circuit 104 is formed. By forming a photodiode or a phototransistor over the substrate where a thin film transistor is formed, a reduction in cost of the electronic book can be achieved.

The display control portion 101 includes an arithmetic circuit 106 (also referred to as a micro-processing unit (MPU)), a memory portion 107, a data input/output portion 108, an operation portion 109, a power supply portion 110, a grayscale correction circuit 111, and an image signal generation circuit 112, and the components are connected via an interface or the like. Note that the data input/output portion 108 may have an antenna for transmitting/receiving data to/from an external device.

The data input/output portion 108 functions to transfer data that are received by an antenna or data that are stored in a recording medium to the memory portion 107. The memory portion 107 stores data on an image signal transferred from the data input/output portion 108 via the interface or the like. The memory portion 107 also stores a program for the arithmetic circuit 106 to carry out a process for controlling the grayscale correction circuit 111, in accordance with a signal from the illuminance sensor 105, the power supply portion 110, the operation portion 109, or the like. An example of the memory portion 107 includes a read-only memory (ROM) or a random access memory (RAM) for storing data on an image signal, a program for the arithmetic circuit 106 to carry out an operation, and the like.

The operation portion 109 functions to encode an operation by a user via a touch panel and/or an operation button with a movable portion used for operation, and to transfer the encoded operation to the arithmetic circuit 106. The power supply portion 110 functions to conduct wireless or wired power supply or conduct power supply with a power storage unit such as a battery or a capacitor to each circuit of the display panel 100.

The grayscale correction circuit 111 functions to correct a grayscale level of an image signal to be input to the image signal generation circuit 112 for the display portion 102 to display a grayscale image, in accordance with the control by the arithmetic circuit 106. The grayscale correction circuit 111 is a circuit for performing a correction of a grayscale level of an image signal, such as a correction by which an image signal to be supplied to a pixel which performs white display is changed to an image signal for black display or a correction by which an image signal to be supplied to a pixel which performs black display is changed to an image signal for white display, in the case of taking as an example an image signal for a black-and-white binary image. Note that the grayscale correction circuit 111 may perform a correction by which a grayscale level is inverted in the case of correcting a grayscale level of an image signal for a multi-level grayscale image, for example. In the case of a multi-level grayscale image, a correction by which a grayscale level is inverted after the number of grayscale levels is reduced may be performed.

The image signal generation circuit 112 is a circuit for supplying a clock signal, a start pulse, an image signal, and the like for the display panel 100 to perform display, in accordance with the image signal corrected by the grayscale correction circuit 111 in accordance with the control by the arithmetic circuit 106. Note that the image signal generation circuit 112 may have an incorporated driver circuit to supply a signal for driving the pixel circuit 104. In this case, the driver circuit that is a signal line driver circuit or a scan line driver circuit may be provided inside the display control portion.

Figure 2A:
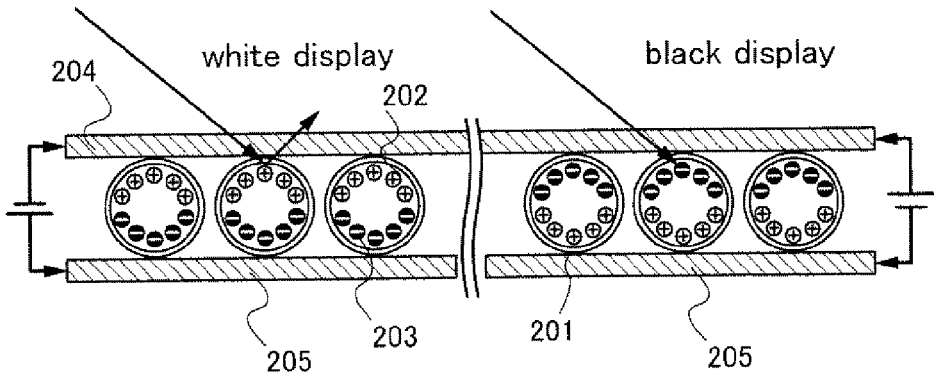
FIGS. 2A to 2C are schematic diagrams illustrating an embodiment of the present invention.
Figure 2B:
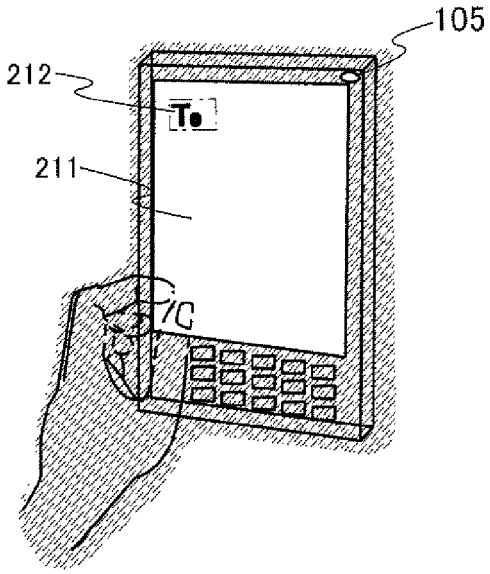
Figure 2C:
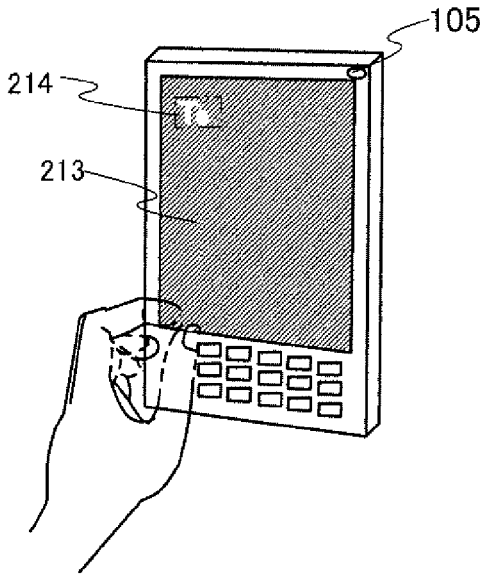

Next, a structure of an electrophoretic element controllable by the pixel circuit 104 that is included in the pixel 103 of the display portion 102 is illustrated in FIG. 2A, and FIGS. 2B and 2C each illustrate an example of a state obtained by the operation of the electronic book of this embodiment, and the effect thereof is described.

FIG. 2A is a cross-sectional view of an electrophoretic display element interposed between electrodes. FIG. 2A is a cross-sectional view of an electrophoretic display element (a microcapsule electrophoretic element), in which positively charged white microparticles 202 and negatively charged black microparticles 203 are encapsulated in a microcapsule 201 between a pair of electrodes, an electrode 204 and an electrode 205.

The microcapsule electrophoretic element performs display with the use of a transparent liquid, the positively charged white microparticles 202, and the negatively charged black microparticles 203 encapsulated in the microcapsule 201 having a diameter of about 10 μm to 200 μm. When an electric field is applied by the electrode 204 and the electrode 205 between which the microcapsule 201 is interposed, the white microparticles and the black microparticles move to opposite directions to each other. The white microparticles 202 have higher external light reflectance than the black microparticles 203, and black or white can be displayed by varying the amount of external light reflected (in the drawing, white display is on the left and black display is on the right).

The electrophoretic display element has a higher external light reflectance than a liquid crystal element, and therefore the display portion can be recognized also in a dim place. However, in a dark place such as an indoor area not lit by a light or an outdoor area at night, the visibility of the display portion is extremely low. In particular, in the case where more pixels in the display portion are supplied with an image signal for displaying a black image (black grayscale level signal) than those supplied with an image signal for displaying a white image (white grayscale level signal), the visibility of the display portion is lower. Therefore, in the case of a black-and-white binary image, visibility can be improved by performing display of the display portion by obtaining the level of external light illuminance with the illuminance sensor 105 and then performing a process for inverting a black grayscale level signal to a white grayscale level signal (black-to-white inversion) with the grayscale correction circuit. In other words, as shown in FIG. 2B, black characters 212 are displayed in the display portion on a white background 211. Note that an electronic book mainly displays textual information in black and white and thus does not cause any problem because it does not provide a strong feeling of strangeness with respect to original data due to black-to-white inversion. In addition, in the case of monochrome multi-level grayscale display, a similar effect can be obtained by grayscale inversion.

In a sunny outdoor area where illuminance is high, the display portion including the electrophoretic display element has high reflectance for external light with which the electrophoretic display element is irradiated, and therefore the contrast of black and white may be hard to recognize in some cases. In particular, in the case where more pixels in the display portion are supplied with a white grayscale level signal than those supplied with a black grayscale level signal, the visibility of the display portion is lower. Therefore, visibility can be improved by performing display of the display portion by obtaining the level of external light illuminance with the illuminance sensor 105 and then performing a process for inverting a white grayscale level signal to a black grayscale level signal (white-to-black inversion) with the grayscale correction circuit. In other words, as shown in FIG. 2C, white characters 214 are displayed in the display portion on a black background 213. Note that an electronic book mainly displays textual information in black and white and thus does not cause any problem because it does not provide a strong feeling of strangeness with respect to original data due to white-to-black inversion. In addition, in the case of monochrome multi-level grayscale display, a similar effect can be obtained by grayscale inversion.

Note that a display device including an electrophoretic display element to which this principle is applied is also called electronic paper. A microcapsule electrophoretic element has a nonvolatile property which enables display even after power is turned off and is effective at reducing power consumption. Note that a space around the microcapsule 201 is filled with a filler such as a resin. In addition, the electrode 204 or the electrode 205 corresponds to a pixel electrode. Instead of the microcapsule electrophoretic element, an electrophoretic display element using a twist ball display method can be used. The twist ball display method refers to a method in which spherical particles each colored in black and white are arranged between a pair of electrodes, and a potential difference is generated between the electrodes to control the orientation of the spherical particles, so that display is performed.

Figure 3:
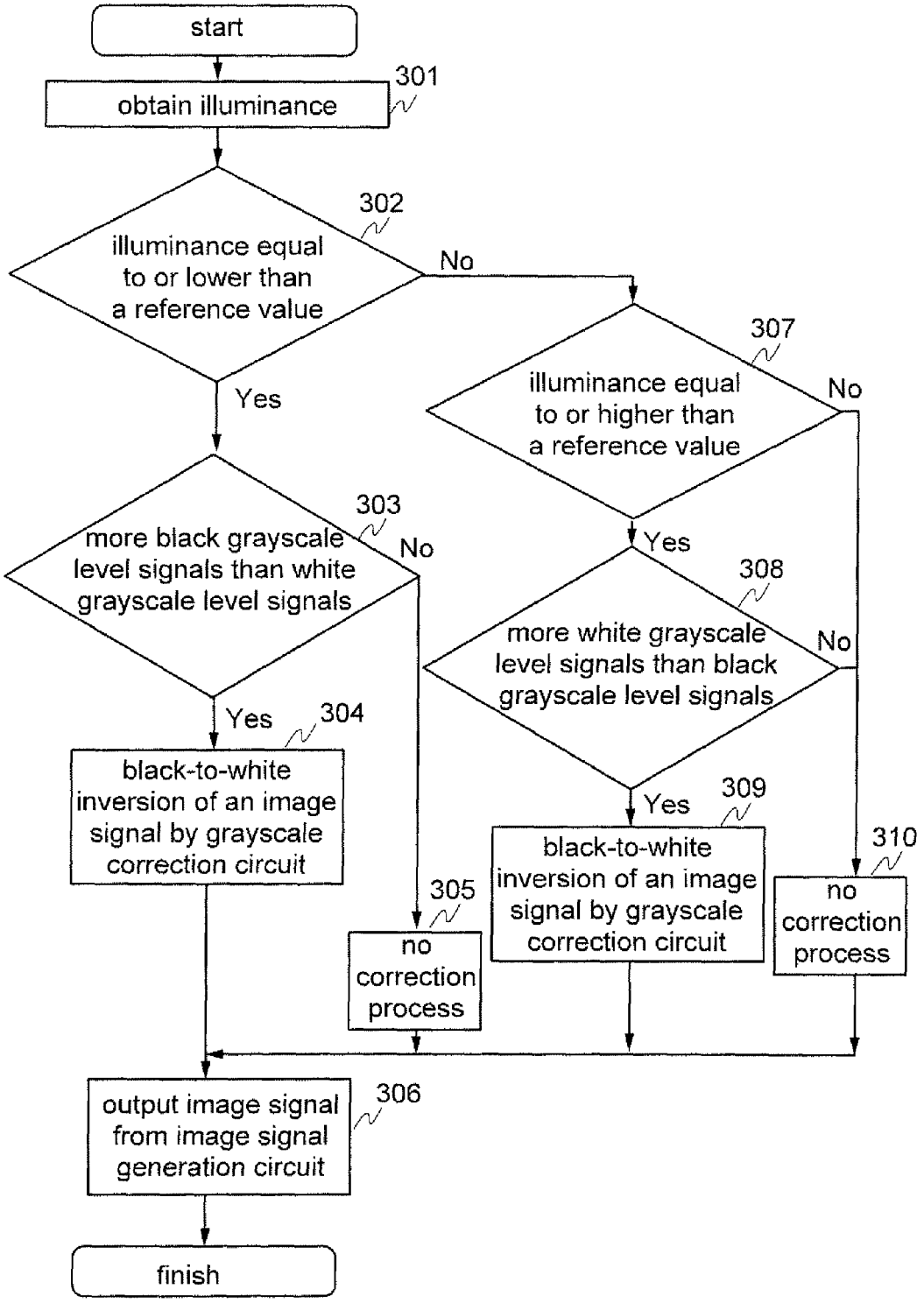
FIG. 3 is a flow chart illustrating an embodiment of the present invention.

Next, the operation of the electronic book 10 shown in FIG. 1 is described with reference to FIG. 3 which illustrates an example of a flow chart. First, the illuminance of the display portion 102 is obtained with the illuminance sensor 105 (Step 301 in FIG. 3). Next, the arithmetic circuit 106 determines whether or not the level of illuminance is equal to or lower than a reference value (Step 302 in FIG. 3). Note that the reference value of illuminance may be set to a given value and, for example, may be set to an illuminance for environmental setting according to the illuminance standard of Japanese Industrial Standards (see JIS Z9110-1979) such that a process for correcting an image signal is performed when the illuminance is equal to or lower than the illuminance according to the illuminance standard. Note that in an environment where illuminance changes at short intervals, the determination as to whether or not the process for correcting an image signal is performed is frequently repeated, in which case the visibility may be lowered on the contrary. Therefore, in an environment where illuminance repeatedly changes between predetermined values, it is preferable to set the operation to either one of the modes. In the case where the level of illuminance is equal to or lower than the reference value (also called a first reference value or a dark place reference value) in Step 302, the arithmetic circuit 106 determines whether or not there are more black grayscale level signals than white grayscale level signals with respect to grayscale levels of image signals that are input to pixels in one screen (Step 303 in FIG. 3). Note that in Step 303, the determination as to the frequencies of white grayscale level signals and black grayscale level signals may be performed by calculating a histogram of grayscale levels of image signals input to pixels in one screen and comparing it with a predetermined reference threshold curve. By performing the determination in Step 303 using a histogram of grayscale levels of image signals input to pixels in one screen, the determination as to the frequencies of white grayscale level signals and black grayscale level signals can be performed with a high degree of freedom without limitation to the frequencies of white grayscale level signals and black grayscale level signals. In the case where it is determined in Step 303 that there are more black grayscale level signals than white grayscale level signals, the grayscale correction circuit 111 performs a correction process for black-to-white inversion of an image signal (Step 304 in FIG. 3). In the case where it is determined in Step 303 that there are fewer black grayscale level signals than white grayscale level signals, the grayscale correction circuit 111 does not perform a correction process for black-to-white inversion of an image signal (Step 305 in FIG. 3). Next, the image signal generation circuit 112 converts the image signal, which has been or has not been subjected to the correction process by the grayscale correction circuit 111, to a signal for the display portion to perform display and then outputs the signal (Step 306 in FIG. 3). In the case where the level of illuminance is equal to or lower than the reference value in Step 302, the arithmetic circuit 106 then determines whether or not the level of illuminance is equal to or higher than a reference value (also called a second reference value or a bright place reference value) (Step 307 in FIG. 3). The operation is preferably set such that the determination as to whether or not the level of illuminance is equal to or higher than the reference value is performed when the illuminance is significantly high in order to prevent frequent correction processes. In the case where the level of illuminance is equal to or higher than the reference value in Step 307, the arithmetic circuit 106 determines whether or not there are more white grayscale level signals than black grayscale level signals among image signals (Step 308 in FIG. 3). Note that in Step 308, as in Step 303, the determination as to the frequencies of white grayscale level signals and black grayscale level signals may be performed by calculating a histogram of grayscale levels of image signals input to pixels in one screen and comparing it with a predetermined reference threshold curve. By performing the determination in Step 308 using a histogram of grayscale levels of image signals input to pixels in one screen, the determination as to the frequencies of white grayscale level signals and black grayscale level signals can be performed with a high degree of freedom without limitation to the frequencies of white grayscale level signals and black grayscale level signals. In the case where it is determined in Step 308 that there are more white grayscale level signals than black grayscale level signals, the grayscale correction circuit 111 performs a correction process for white-to-black inversion of an image signal (Step 309 in FIG. 3). In the case where it is determined in Step 307 that the level of illuminance is equal to or lower than the reference value and it is determined in Step 308 that there are fewer white grayscale level signals than black grayscale level signals, the grayscale correction circuit 111 does not perform a correction process for white-to-black inversion of an image signal (Step 310 in FIG. 3). Next, the operation proceeds to Step 306 after Step 309 or Step 310.

As described above, a white background and a black background have different reflectances for external light, and therefore visibility can be ensured even in the case where contrast changes depending on the level of illuminance.

Note that this embodiment can be combined or replaced with any of the other embodiments as appropriate.

Embodiment 2

With reference to FIG. 4, FIGS. 5A and 5B, and FIG. 6, an outline of a structure different from that in the above embodiment is described. Note that description that overlaps with the description of the structure of the electronic book in Embodiment 1 is omitted and the description of Embodiment 1 is employed.

Figure 4:
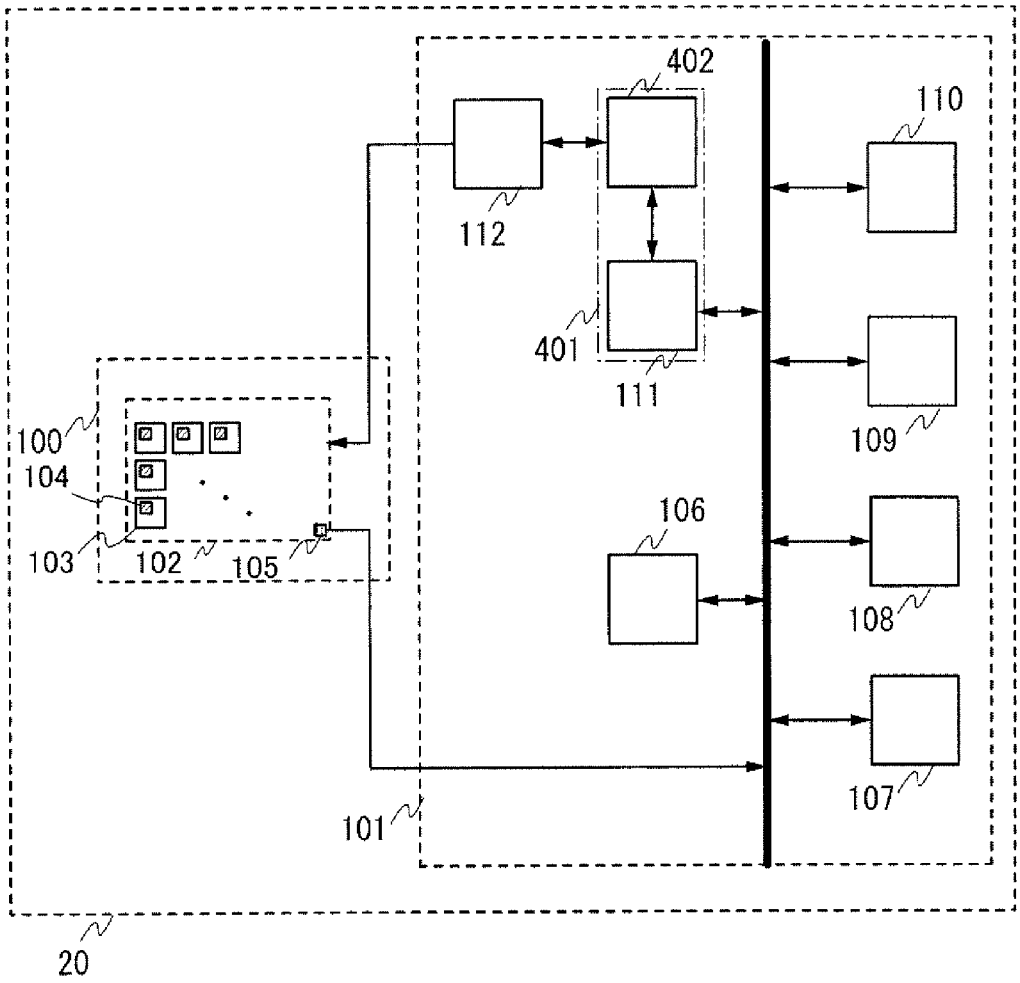
FIG. 4 is a block diagram illustrating an embodiment of the present invention.

FIG. 4 is a block diagram of an electronic book described in this embodiment. An electronic book 20 shown in FIG. 4 includes a display panel 100 and a display control portion 101.

Note that the description of the display panel 100 is similar to that in Embodiment 1, and the display panel 100 includes a display portion 102, a plurality of pixels 103, a pixel circuit 104, and an illuminance sensor 105.

Figure 5A:
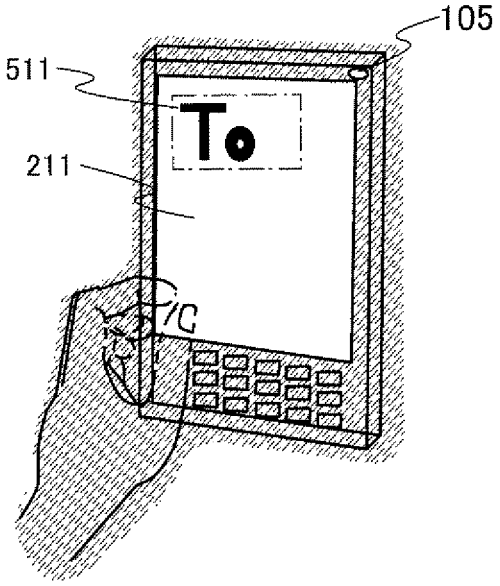
FIGS. 5A and 5B are schematic diagrams illustrating an embodiment of the present invention.
Figure 5B:
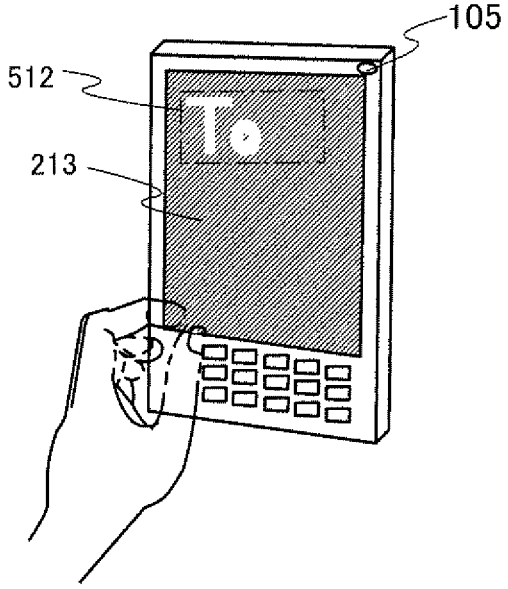

The display control portion 101 includes, as in Embodiment 1, an arithmetic circuit 106, a memory portion 107, a data input/output portion 108, an operation portion 109, a power supply portion 110, and an image signal generation circuit 112, and the components are connected via an interface or the like. This embodiment differs from Embodiment 1 in that a combination of a grayscale correction circuit 111 and a character enlargement circuit 402 is provided as an image signal correction circuit 401. Note that the character enlargement circuit 402 is a circuit for performing a process for enlarging black characters 511 to be displayed in the display portion on a white background 211 as shown in FIG. 5A when external light is dim. The character enlargement circuit 402 may perform a process for enlarging white characters 512 to be displayed in the display portion on a black background 213 as shown in FIG. 5B when external light is bright.

Next, the operation of the electronic book 20 shown in FIG. 4 is described with reference to FIG. 6 which illustrates an example of a flow chart. First, the illuminance of the display portion 102 is obtained with the illuminance sensor 105 (Step 301 in FIG. 6). Next, the arithmetic circuit 106 determines whether or not the level of illuminance is equal to or lower than a reference value (Step 302 in FIG. 6). Note that the reference value of illuminance may be set to a given value and, for example, may be set to an illuminance according to the illuminance standard of Japanese Industrial Standards (see JIS Z9110-1979) such that a process for correcting an image signal is performed when the illuminance is equal to or lower than the illuminance according to the illuminance standard. In the case where the level of illuminance is equal to or lower than the reference value (also called a first reference value or a dark place reference value) in Step 302, the arithmetic circuit 106 determines whether or not there are more black grayscale level signals than white grayscale level signals with respect to grayscale levels of image signals that are input to pixels in one screen (Step 303 in FIG. 6). Note that in Step 303, the determination as to the frequencies of white grayscale level signals and black grayscale level signals may be performed by calculating a histogram of grayscale levels of image signals input to pixels in one screen and comparing it with a predetermined reference threshold curve. By performing the determination in Step 303 using a histogram of grayscale levels of image signals input to pixels in one screen, the determination as to the frequencies of white grayscale level signals and black grayscale level signals can be performed with a high degree of freedom without limitation to the frequencies of white grayscale level signals and black grayscale level signals. In the case where it is determined in Step 303 that there are more black grayscale level signals than white grayscale level signals, the gray scale correction circuit 111 performs a correction process for black-to-white inversion of an image signal (Step 304 in FIG. 6). In the case where it is determined in Step 303 that there are fewer black grayscale level signals than white grayscale level signals, the grayscale correction circuit 111 does not perform a correction process for black-to-white inversion of an image signal (Step 305 in FIG. 6). Next, the image signal generation circuit 112 converts the image signal, which has been or has not been subjected to the correction process by the grayscale correction circuit 111, to a signal for the display portion to perform display and then outputs the signal (Step 306 in FIG. 6). In the case where the level of illuminance is equal to or lower than the reference value in Step 302, the arithmetic circuit 106 then determines whether or not the level of illuminance is equal to or higher than a reference value (also called a second reference value or a bright place reference value) (Step 307 in FIG. 6). The operation is preferably set such that the determination as to whether or not the level of illuminance is equal to or higher than the reference value is performed when the illuminance is significantly high in order to prevent frequent correction processes. In the case where the level of illuminance is equal to or higher than the reference value in Step 307, the arithmetic circuit 106 determines whether or not there are more white grayscale level signals than black grayscale level signals among image signals (Step 308 in FIG. 6). Note that in Step 308, as in Step 303, the determination as to the frequencies of white grayscale level signals and black grayscale level signals may be performed by calculating a histogram of grayscale levels of image signals input to pixels in one screen and comparing it with a predetermined reference threshold curve. By performing the determination in Step 308 using a histogram of grayscale levels of image signals input to pixels in one screen, the determination as to the frequencies of white grayscale level signals and black grayscale level signals can be performed with a high degree of freedom without limitation to the frequencies of white grayscale level signals and black grayscale level signals. In the case where it is determined in Step 308 that there are more white grayscale level signals than black grayscale level signals, the grayscale correction circuit 111 performs a correction process for white-to-black inversion of an image signal (Step 309 in FIG. 6). In the case where it is determined in Step 307 that the level of illuminance is equal to or lower than the reference value and it is determined in Step 308 that there are fewer white grayscale level signals than black grayscale level signals, the gray scale correction circuit 111 does not perform a correction process for white-to-black inversion of an image signal (Step 310 in FIG. 6). Next, the operation proceeds to Step 306 after Step 309 or Step 310.

Figure 6:
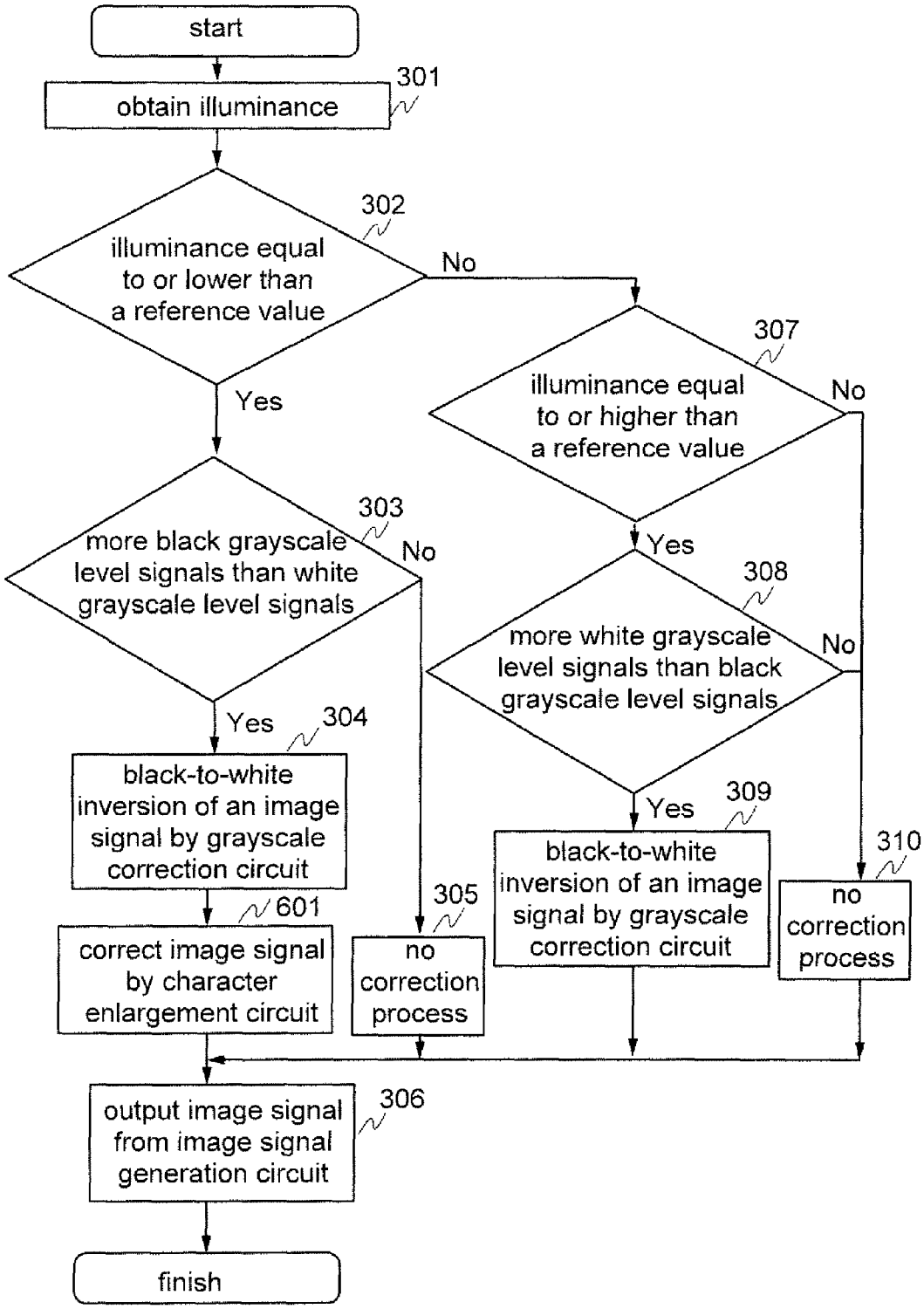
FIG. 6 is a flow chart illustrating an embodiment of the present invention.

Note that in this embodiment, as a process different from those in Embodiment 1, the character enlargement circuit 402 performs a process for enlarging a character portion of an image signal between Step 304 and Step 306 as shown in FIG. 6 (Step 601 in FIG. 6). By adding this step, a circuit capable of varying the size of characters depending on external light illuminance can be added, and visibility can be further improved.

As described above, a white background and a black background have different reflectances for external light, and therefore visibility can be ensured even in the case where contrast changes depending on the level of illuminance. In addition, in the structure of this embodiment, a circuit capable of varying the size of characters depending on external light illuminance can be added, and visibility can be further improved.

Note that this embodiment can be combined or replaced with any of the other embodiments as appropriate.

Embodiment 3

In this embodiment, an example of a display panel for an electronic book will be described. The display panel may be either a passive matrix type or an active matrix type.

As the display panel, an electrophoretic display device including an electrophoretic display element can be used. The display panel is a panel in which a display element is sealed, and to which a connector such as a flexible printed circuit (FPC), a tape automated bonding (TAB) tape, or a tape carrier package (TCP) is attached and an external circuit including a signal line driver circuit is electrically connected. An IC including a signal line driver circuit may be directly mounted on the display panel by a chip on glass (COG) method.

Figure 7A:
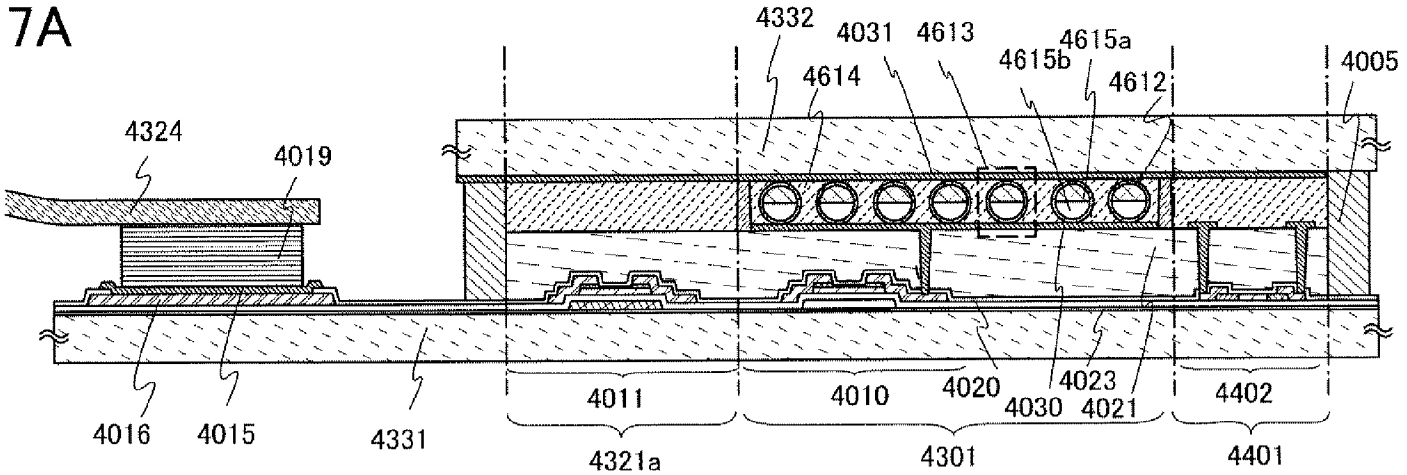
FIGS. 7A and 7B are cross-sectional views illustrating an embodiment of the present invention.
Figure 7B:
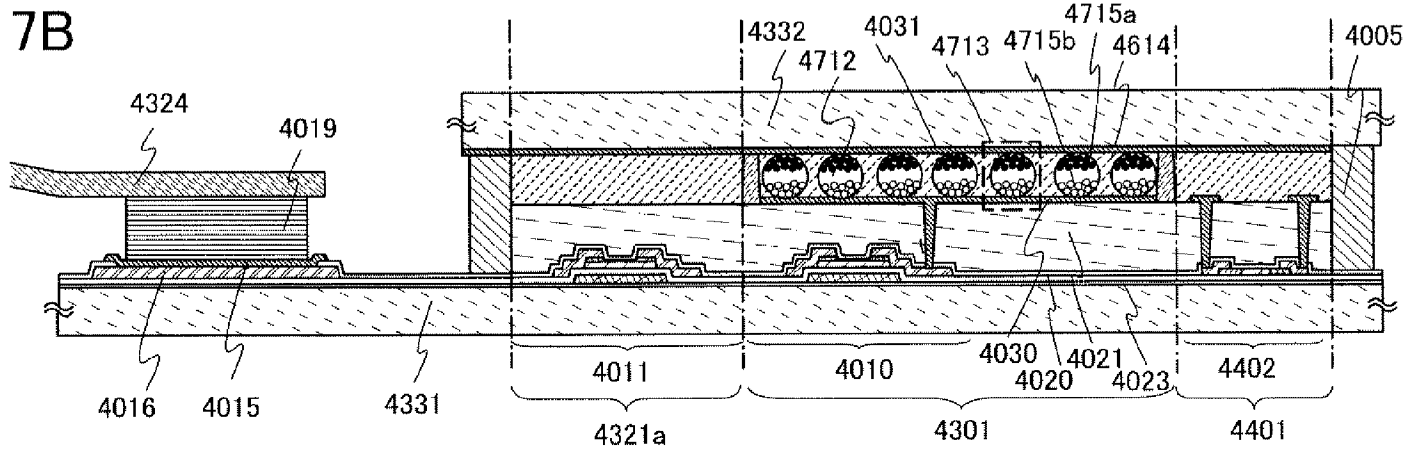
Figure 8:
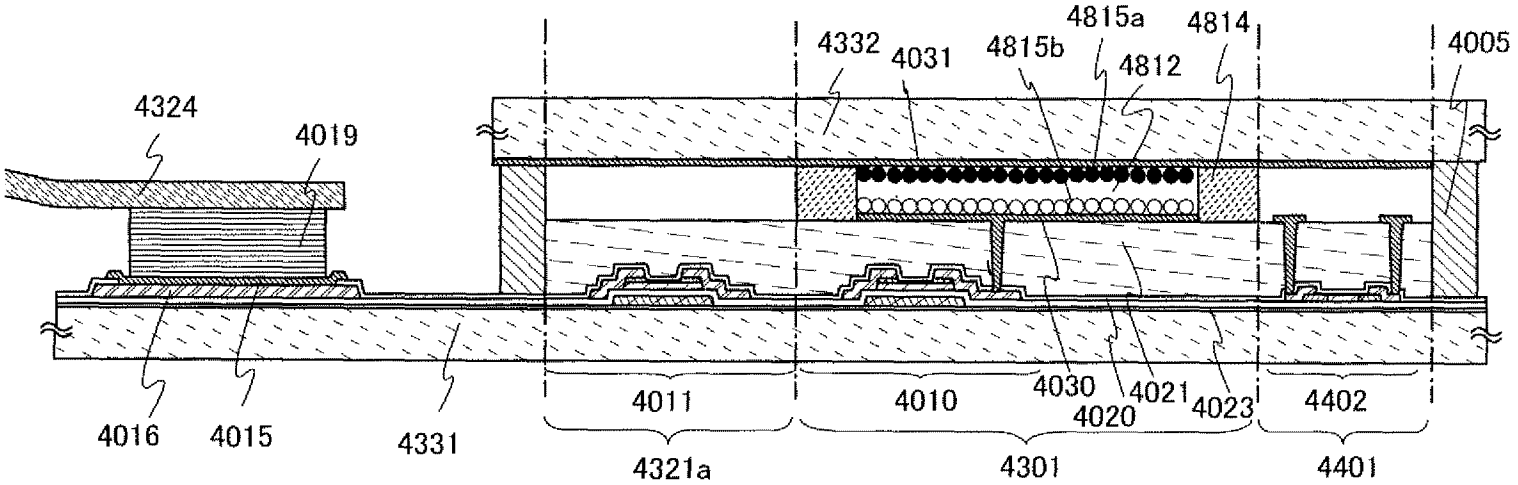
FIG. 8 is a cross-sectional view illustrating an embodiment of the present invention.

Modes of the display panel are described below with reference to FIGS. 7A and 7B and FIG. 8. FIGS. 7A and 7B and FIG. 8 show examples in which an FPC 4324 is attached to an element substrate 4331 that is provided with a display portion 4301 including a pixel circuit, an illuminance sensor portion 4401 including a photodiode, and a driver circuit portion 4321*a* including a driver circuit. The display portion 4301, the illuminance sensor portion 4401, and the driver circuit portion 4321*a* provided over the element substrate 4331 are sealed with a sealing substrate 4332 by a sealant 4005.

As shown in FIGS. 7A and 7B and FIG. 8, a connection terminal electrode 4015 and a terminal electrode 4016 are provided over the element substrate 4331, and the connection terminal electrode 4015 and the terminal electrode 4016 are electrically connected to a terminal included in the FPC 4324 through an anisotropic conductive film 4019.

The connection terminal electrode 4015 is formed using the same conductive film as a first electrode layer 4030, and the terminal electrode 4016 is formed using the same conductive film as source and drain electrode layers of thin film transistors 4010 and 4011 and an electrode layer of a photodiode 4402. Note that an example is shown here in which a semiconductor layer of the photodiode 4402 is formed together with semiconductor layers of the thin film transistors 4010 and 4011. Insulating layers 4020 and 4021 are provided over the thin film transistors 4010 and 4011 and the photodiode 4402. Note that an insulating film 4023 is an insulating film serving as a base film.

A variety of thin film transistors can be employed as the thin film transistors 4010 and 4011 without particular limitation. FIGS. 7A and 7B and FIG. 8 each illustrate an example in which inverted staggered thin film transistors having a bottom gate structure are used as the thin film transistors 4010 and 4011. Although the thin film transistors 4010 and 4011 are channel-etched thin film transistors, they may be channel-protective inverted staggered thin film transistors in which a channel protective film is provided over a semiconductor layer.

In the display panel, the thin film transistor 4010 included in the display portion 4301 is electrically connected to a display element. As a driving method for driving the display element, there are methods such as a twist ball method, a microcapsule method, and a powder method (also called a toner display).

The display panel of FIG. 7A is an example of an electrophoretic display device using a twist ball method. The twist ball display method refers to a method in which spherical particles each colored in black and white are arranged between electrode layers included in a display element, and a potential difference is generated between the electrode layers to control the orientation of the spherical particles, so that display is performed.

Between the first electrode layer 4030 connected to the thin film transistor 4010 and a second electrode layer 4031 provided for the sealing substrate 4332, spherical particles 4613 each of which includes a black region 4615*a*, a white region 4615*b*, and a cavity 4612 which is filled with a liquid around the black region 4615*a* and the white region 4615*b*, are provided. A space around the spherical particles 4613 is filled with a filler 4614 such as a resin. The second electrode layer 4031 corresponds to a common electrode (a counter electrode). The second electrode layer 4031 is electrically connected to a common potential line.

In addition, an electrophoretic display device using a microcapsule method instead of the twist ball method is also possible. FIG. 7B shows an example in which a display element having microcapsules with microparticles encapsulated therein is used as a display element. Microcapsules 4713 each having a diameter of about 10 μm to 200 μm, in which a transparent liquid 4712, negatively charged black microparticles 4715*a* as first particles, and positively charged white microparticles 4715*b* as second particles are encapsulated, are used.

In the microcapsules 4713 provided between the first electrode layer 4030 and the second electrode layer 4031, when an electric field is applied by the first electrode layer 4030 and the second electrode layer 4031, the white microparticles 4715*b* and the black microparticles 4715*a* move to opposite directions to each other, so that white or black can be displayed.

Note that the first particles and the second particles each contain a pigment and do not move without an electric field. Moreover, the colors of the first particles and the second particles are different from each other (the particles may be colorless).

A solution in which the above microcapsules are dispersed in a solvent is referred to as electronic ink. This electronic ink can be applied to a surface of glass, plastic, cloth, paper, or the like by printing. Furthermore, by using a color filter or particles that have a pigment, color display can also be achieved.

Note that the first particles and the second particles in the microcapsules may each be formed of a single material selected from a conductive material, an insulating material, a semiconductor material, a magnetic material, a liquid crystal material, a ferroelectric material, an electroluminescent material, an electrochromic material, and a magnetophoretic material, or formed of a composite material of any of these materials.

Electronic liquid powders (registered trademark) can be used for a powder method. An example of the case where electronic liquid powders are used as the display element is illustrated in FIG. 8. A positively charged black liquid powder 4815*a* and a negatively charged white liquid powder 4815*b* are contained in a space 4812 segmented by the first electrode layer 4030, the second electrode layer 4031, and a rib 4814. The space 4812 is filled with air.

When an electric field is applied by the first electrode layer 4030 and the second electrode layer 4031, the black liquid powder 4815*a* and the white liquid powder 4815*b* move in opposite directions to display white or black. As the liquid powders, color powders of red, yellow, and/or blue may be used.

In FIGS. 7A and 7B, a plastic having light-transmitting properties can be used for each of the element substrate 4331 and the sealing substrate 4332. As plastic, a fiberglass-reinforced plastics (FRP) plate, a polyvinyl fluoride (PVF) film, a polyester film, or an acrylic resin film can be used. In addition, a sheet with a structure in which an aluminum foil is sandwiched between PVF films or polyester films can be used.

The insulating layer 4020 serves as a protective film for the thin film transistors. Note that the protective film is provided to prevent entry of impurities floating in the air, such as an organic substance, a metal substance, or moisture, and is preferably a dense film. The protective film may be formed with a single layer or a stacked layer of a silicon oxide film, a silicon nitride film, a silicon oxynitride film, a silicon nitride oxide film, an aluminum oxide film, an aluminum nitride film, an aluminum oxynitride film, and/or an aluminum nitride oxide film by a sputtering method.

Furthermore, the insulating layer 4021 serving as a planarizing insulating film can be formed using an organic material having heat resistance, such as polyimide, acrylic, benzocyclobutene, polyamide, or epoxy. Other than such organic materials, it is also possible to use a low-dielectric constant material (a low-k material), a siloxane-based resin, phosphosilicate glass (PSG), borophosphosilicate glass (BPSG), or the like. Note that the insulating layer may be formed by stacking a plurality of insulating films formed using any of these materials.

There is no particular limitation on the method of forming the insulating layers 4020 and 4021. Any of the following methods can be used depending on the material of the insulating layers 4020 and 4021: a sputtering method, an SOG method, spin coating, dip coating, spray coating, a droplet discharge method (e.g., an inkjet method, screen printing; or offset printing), a doctor knife, a roll coater, a curtain coater, a knife coater, or the like. In the case where the insulating layers are formed using a material solution, the semiconductor layer may be annealed (at 200° C. to 400° C.) at the same time as a baking step. When the step of baking the insulating layers and the step of annealing the semiconductor layer are performed at the same time, a display panel can be manufactured efficiently.

The display panel displays an image by transmitting light from a light source or a display element. Therefore, the substrate and thin films such as insulating films and conductive films provided for the display portion where light is transmitted have light-transmitting properties with respect to light in the visible-light wavelength range.

The first electrode layer 4030 and the second electrode layer 4031 for applying voltage to the display element may have light-transmitting properties or light-reflecting properties, depending on the direction in which light is extracted, the position where the electrode layers are provided, the pattern structure of the electrode layers, and the like.

The first electrode layer 4030 and the second electrode layer 4031 can be formed using a light-transmitting conductive material such as indium oxide containing tungsten oxide, indium zinc oxide containing tungsten oxide, indium oxide containing titanium oxide, indium tin oxide containing titanium oxide, indium tin oxide (hereinafter referred to as ITO), indium zinc oxide, or indium tin oxide to which silicon oxide is added.

The first electrode layer 4030 and the second electrode layer 4031 can each be formed using one kind or plural kinds of metal such as tungsten (W), molybdenum (Mo), zirconium (Zr), hafnium (Hf), vanadium (V), niobium (Nb), tantalum (Ta), chromium (Cr), cobalt (Co), nickel (Ni), titanium (Ti), platinum (Pt), aluminum (Al), copper (Cu), or silver (Ag); an alloy thereof; and a nitride thereof.

The first electrode layer 4030 and the second electrode layer 4031 can be formed using a conductive composition containing a conductive high molecular compound (also referred to as a conductive polymer). As the conductive high molecular compound, a so-called π-electron conjugated conductive high molecular compound can be used. For example, polyaniline or a derivative thereof, polypyrrole or a derivative thereof, polythiophene or a derivative thereof, a copolymer of two or more kinds of them, and the like can be given.

Since the thin film transistor is easily broken due to static electricity or the like, a protective circuit for protecting the driver circuit is preferably provided.

This embodiment can be implemented in an appropriate combination with any of the structures described in the other embodiments.

This application is based on Japanese Patent Application serial no. 2009-182946 filed with Japan Patent Office on Aug. 6, 2009, the entire contents of which are hereby incorporated by reference.

What is claimed is:

1. An electronic book comprising:

a display panel comprising a plurality of pixels and an illuminance sensor, each of the plurality of pixels comprising an electrophoretic display element;

a display control portion comprising a circuit configured to correct an image signal for the electrophoretic display element in accordance with illuminance detected by the illuminance sensor and a ratio of black grayscale level signals to white grayscale level signals among image signals to be input to the pixels in one screen; and a pixel circuit operationally connected to the electrophoretic display element, wherein the correction of the image signal is a process for inverting a grayscale level of the image signal from black to white or from white to black, wherein the process for inverting the grayscale level is performed when there are more black grayscale level signals than white grayscale level signals, and wherein the process for inverting the grayscale level is not performed when there are fewer black grayscale level signals than white grayscale level signals.

2. The electronic book according to claim 1, wherein the display control portion comprises a memory portion, a data input/output portion, an operation portion, and a power supply portion.

3. An electronic book comprising:

a display panel comprising a plurality of pixels and an illuminance sensor, each of the plurality of pixels comprising an electrophoretic display element;

a display control portion comprising a grayscale correction circuit, an arithmetic circuit, and an image signal generation circuit; and a pixel circuit operationally connected to the electrophoretic display element, wherein the arithmetic circuit is configured to compare a level of illuminance detected by the illuminance sensor with reference values and to determine a ratio of black grayscale level signals to white grayscale level signals among image signals to be input to the pixels in one screen, wherein the grayscale correction circuit controllable by the arithmetic circuit is configured to correct a grayscale level of an image signal to be input to the image signal generation circuit, for the electrophoretic display element in accordance with the illuminance detected by the illuminance sensor and the ratio of the black grayscale level signals to the white grayscale level signals among the image signals to be input to the pixels in one screen, wherein the correction of the grayscale level of the image signal is a process for inverting the grayscale level of the image signal from black to white or from white to black, wherein the process for inverting the grayscale level is performed when there are more black grayscale level signals than white grayscale level signals, and wherein the process for inverting the grayscale level is not performed when there are fewer black grayscale level signals than white grayscale level signals.

4. The electronic book according to claim 3, wherein the display control portion comprises a memory portion, a data input/output portion, an operation portion, and a power supply portion.

5. An electronic book comprising:

a display panel comprising a plurality of pixels and an illuminance sensor, each of the plurality of pixels comprising an electrophoretic display element;

a display control portion comprising a circuit configured to correct an image signal for the electrophoretic display element to display an enlarged character and a circuit configured to correct the image signal in accordance with illuminance detected by the illuminance sensor and a ratio of black grayscale level signals to white grayscale level signals among image signals to be input to the pixels in one screen; and a pixel circuit operationally connected to the electrophoretic display element, wherein the correction of the image signal is a process for inverting a grayscale level of the image signal from black to white or from white to black, wherein the process for inverting the grayscale level is performed when there are more black grayscale level signals than white grayscale level signals, and wherein the process for inverting the grayscale level is not performed when there are fewer black grayscale level signals than white grayscale level signals.

6. The electronic book according to claim 5, wherein the display control portion comprises a memory portion, a data input/output portion, an operation portion, and a power supply portion.

7. An electronic book comprising:

a display panel comprising a plurality of pixels and an illuminance sensor, each of the plurality of pixels comprising an electrophoretic display element;

a display control portion comprising a grayscale correction circuit, an arithmetic circuit, a character enlargement circuit, and an image signal generation circuit; and a pixel circuit operationally connected to the electrophoretic display element, wherein the arithmetic circuit is configured to compare a level of illuminance detected by the illuminance sensor with reference values and to determine a ratio of black grayscale level signals to white grayscale level signals among image signals to be input to the pixels in one screen, wherein the character enlargement circuit controllable by the arithmetic circuit is configured to correct an image signal to be input to the image signal generation circuit, for the electrophoretic display element to display an enlarged character in accordance with the illuminance detected by the illuminance sensor and the ratio of the black grayscale level signals to the white grayscale level signals among the image signals to be input to the pixels in one screen, wherein the grayscale correction circuit controllable by the arithmetic circuit is configured to correct a grayscale level of the image signal to be input to the image signal generation circuit for the electrophoretic display element in accordance with the illuminance detected by the illuminance sensor and the ratio of the black grayscale level signals to the white grayscale level signals among the image signals to be input to the pixels in one screen, and wherein the correction of the grayscale level of the image signal is a process for inverting the grayscale level of the image signal from black to white or from white to black, wherein the process for inverting the grayscale level is performed when there are more black grayscale level signals than white grayscale level signals, and wherein the process for inverting the grayscale level is not performed when there are fewer black grayscale level signals than white grayscale level signals.

8. The electronic book according to claim 7, wherein the display control portion comprises a memory portion, a data input/output portion, an operation portion, and a power supply portion.

* * * * *